US008510891B2

(12) United States Patent
Fivecoate

(10) Patent No.: US 8,510,891 B2
(45) Date of Patent: Aug. 20, 2013

(54) AUGER WITH TENTACLES

(76) Inventor: Clarence E Fivecoate, Delta, CO (US)

( * ) Notice: Subject to any disclaimer, the term of this patent is extended or adjusted under 35 U.S.C. 154(b) by 69 days.

(21) Appl. No.: 12/882,995

(22) Filed: Sep. 15, 2010

(65) Prior Publication Data

US 2011/0289706 A1 Dec. 1, 2011

Related U.S. Application Data

(60) Provisional application No. 61/347,838, filed on May 25, 2010.

(51) Int. Cl.
*B08B 9/02* (2006.01)

(52) U.S. Cl.
USPC ..... 15/104.33; 15/104.32

(58) Field of Classification Search
USPC ..... 15/104.33, 104.32, 104.31, 104.16, 15/104.05, 104.02; 9/104.33, 104.32, 104.31, 9/104.16, 104.05, 104.02
See application file for complete search history.

(56) References Cited

U.S. PATENT DOCUMENTS 1,686,629 A * 10/1928 McCoy ..... 15/200
1,851,766 A * 3/1932 Hotchkiss, Jr. ..... 15/104.33
1,910,768 A * 5/1933 Hotchkiss, Jr. ..... 15/104.33
2,344,758 A * 3/1944 Welsh ..... 431/32
3,121,244 A 2/1964 Hunt
3,950,934 A 4/1976 Irwin
4,364,140 A 12/1982 Irwin
5,765,251 A * 6/1998 Jones ..... 15/104.32
5,769,960 A * 6/1998 Nirmel ..... 134/22.11
5,836,032 A 11/1998 Hondo
6,630,034 B1 * 10/2003 Schnell ..... 134/8
2006/0260079 A1 * 11/2006 Horton ..... 15/165
2008/0047086 A1 * 2/2008 Gunjian ..... 15/206

* cited by examiner

*Primary Examiner* — Robert Scruggs
(74) *Attorney, Agent, or Firm* — Daniel Boudwin

(57) ABSTRACT

A plumbing auger attachment tool which provides means for solid object retrieval from the interior of a toilet waste pipe or other drain pipes. The attachment has a series of rubber tentacles affixed to the end of the spiral wiring of a plumbing snake auger. The lengths of string act to entangle solid debris otherwise blocking the flow of water through the pipe. A magnetic casing also assists to attract ferrous material blockages in the pipe. This improvement on a standard plumbing snake permits solid item retrieval, such as pens and toys, which a wire coil auger is not capable. The strings are sent down the length of pipe at the base of a toilet by a rotating action, which rotates and extends the wire coil auger and the improved attachment. Once entangled with a debris source, that debris can be removed from the pipe to clear the obstruction.

4 Claims, 1 Drawing Sheet

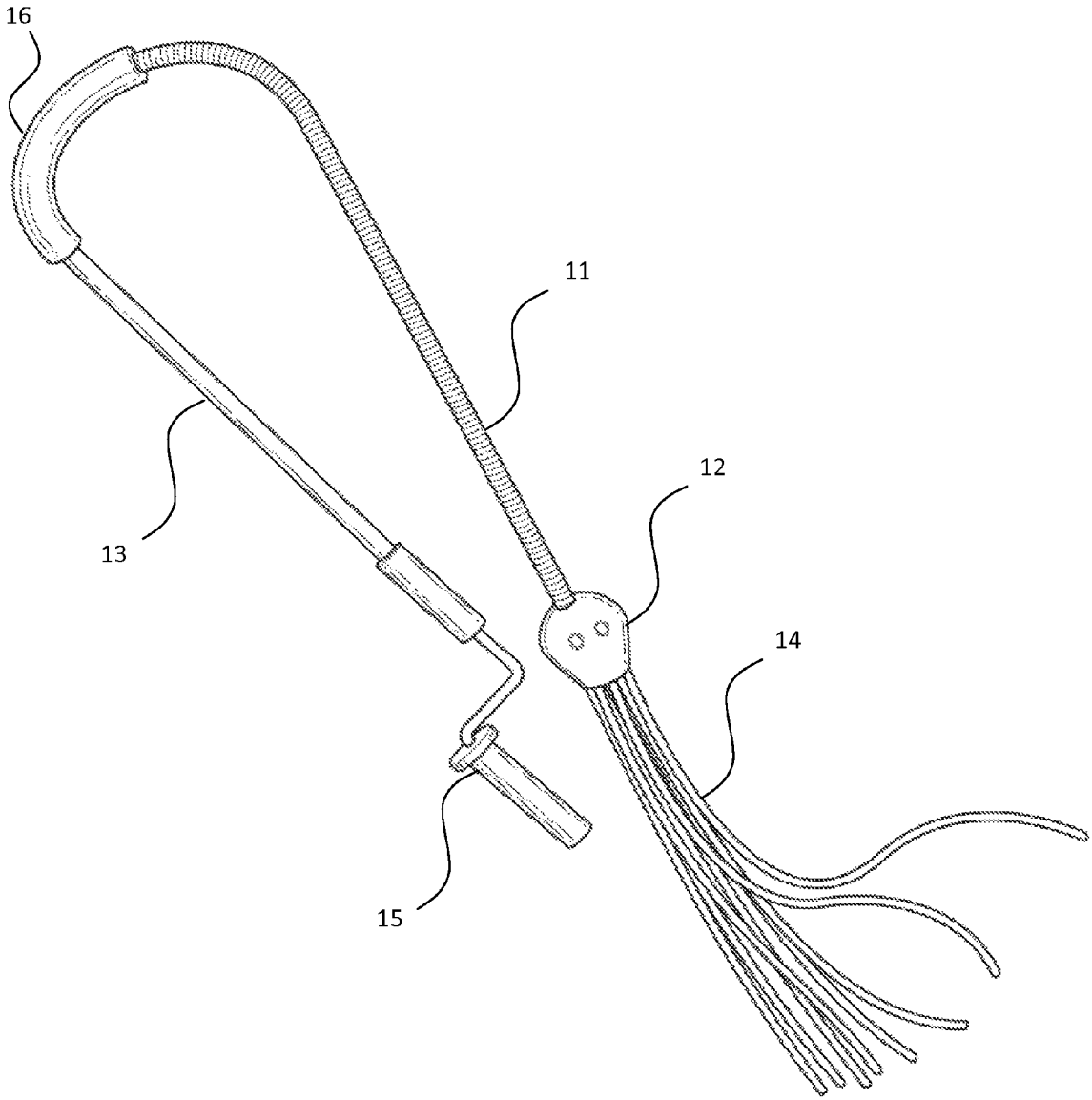
16
11
12
13
14
15

AUGER WITH TENTACLES

CROSS REFERENCE TO RELATED APPLICATION

This application claims the benefit of U.S. Provisional Application No. 61/347,838 filed on May 25, 2010, entitled "Octopus"

BACKGROUND OF THE INVENTION

1. Field of the Invention

The present invention relates to an improvement to a plumber's drain auger, which is used to remove obstructions and retrieve solid debris from toilet waste pipes.

2. Description of the Prior Art

Present tools used for clearing toilet waste pipes include plumbing snakes which are fed down the pipe via hand crank action which extends a rotating coil auger. These tools act to clear blockages by boring themselves into the debris for retrieval, scraping away built-up debris or separating the debris to the degree water can flow past the blockage and restore normal flushing operation of a toilet.

U.S. Pat. No. 5,765,251 to Jones describes a flexible wire wound cable which surrounds a wire cluster terminated in a hook. A handle attached to the wire cluster allowing urging of the wire cluster in sliding motion inside the flexible tube. A handle attached to the flexible tube allowing firm gripping of the flexible tube. A wire cluster made of spring wire and formed to a curl at its extremity and terminating in a hook. A hollow cap fixed to the end of the flexible wire wound cable. A point with holes in it through which the spring wire can slide and protrude in varying length.

U.S. Pat. No. 3,950,934 Irwin describes a plumbers snake and the method of making the same of unique construction having a metal core concentrically disposed within a coiled spring wire member and an intermediate resilient body in gripping engagement with the metal core. The intermediate body includes a helically-shaped protrusion extending along its length, the turns of which are interposed between and operably engage the coils of the spring wire member so as to yieldably resist axial bending of the snake and optimize rigidity and flexibility.

U.S. Pat. No. 5,836,032 Hondo describes an apparatus for removing hair from a drain for facilitating the maintenance of drains by permitting convenient periodic debris removal and cleaning of a drain. The apparatus includes an elongate shaft with a plurality of hook members for picking up hair and debris located at the proximal end of the shaft and a handle located at the distal end.

U.S. Pat. No. 4,364,140 Irwin describes a compact auger-type cleanout tool for use in clearing stoppages in waste pipes associated with sinks, bathtubs, water closets and the like in which any required number of additional lengths of plumbers' snake can be added to the device without removing the snake from the line. The device includes one or more telescoping tubular housings and a drive member associated therewith adapted to transmit rotary movement to the plumbers' snake. The initial length of snake fed into the line includes a uniquely designed coupling leader to which additional lengths of snake can readily be coupled making the device suitable for cleanout of very long runs of waste pipe.

U.S. Pat. No. 3,121,244 to Hunt shows a typical toilet auger, of which the present invention improves on.

These tools have several drawbacks, including an inability to retrieve solid items such as dropped valuables, pens and toys. Wire augers are capable of retrieving paper or cloth obstructions, but are unable to attach and remove rigid objects. Prior art patents that claim grasping fingers at the working end of the auger require the user to operate these grasping fingers, which makes operation difficult. This can also be very difficult when the object's location and its proximity to the tool is out of sight and hence unknown. Furthermore, if an object is pushed with a rigid tool, it may be forced further down the drain and can become permanently lost or lodged.

SUMMARY OF THE INVENTION

In view of the foregoing disadvantages inherent in the known types of plumbing snake augers now present in the prior art, the present invention provides a new attachment wherein the same can be utilized for providing convenience for the user when clearing blockages in waste pipes and retrieving solid objects. The attachment is a series of rubber tentacles which can be used to secure objects in a waste pipe and restore normal drain function.

It is therefore an object of the present invention to provide an improved tool, for attachment to a conventional plumbing auger, that is capable of retrieving solid objects that have been inadvertently dropped down a drain and which may act to clog drain pipes.

Another object of the present invention is to provide a magnetic casing to the tool which can attract ferrous or magnetic objects located in the drain.

Other objects, features and advantages of the present invention will become apparent from the following detailed description taken in conjunction with the accompanying drawings.

BRIEF DESCRIPTIONS OF THE DRAWINGS

FIG. 1 shows a perspective view of a traditional augur with the new casing and tentacles of the present invention attached.

DETAILED DESCRIPTION OF THE INVENTION

Referring now to FIG. 1, there is shown a drive member 13 connected to a crank handle 15. The drive member 13 can have a casing over it, as is typical for most augers. A coupling housing 16, which houses the joint between the drive member 13 and the coiled snake 11. Such joints are commonly used in conventional augers. The coiled snake 11 extends from the joint and has a larger, coiled head at its work end. Again, such features are commonly known and used on conventional augers.

Covering the coiled head is a casing 12. In an alternate embodiment the casing can be magnetic. The casing 12 has several limp tentacles 14 attached to it. The tentacles 14 are used to wrap around objects located in the drain.

In use, the auger can be inserted into a drain within close proximity to an object. Rotation of the crank handle causes the coiled snake to rotate, which in turn causes the tentacles to rotate. The tentacles wrap around the object, at which time the auger, with the object entangled in the tentacles, is removed from the drain. If an object is dropped in the drain but the drain is not clogged, the auger may be inserted in the drain and the drain flushed. The flushed water will draw the tentacles forward and into contact with the object, where it can then be twisted to grasp the object. If the object is metallic, it will attach to the magnetic casing and can be removed from the drain. Such a feature can be of great benefit when, for example, a ring is dropped down a drain and trapped in the bend.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plumbing tool for retrieving solid objects from the interior of a drain pipe, comprising;

a drain auger having a handle end and a work end, said work end having a casing attached thereto, wherein said casing has a plurality of limp tentacles extending therefrom said limp tentacles being operatively connected to said drain auger, wherein operation of said drain auger rotates said tentacles;

said tentacles are adapted to engage solid objects when said tentacles are rotated, by wrapping around said solid object.

2. The apparatus of claim one, wherein said casing is magnetic.

3. A plumbing tool for retrieving solid objects from the interior of a drain pipe, comprising;

a drain auger having a handle end and a work end, said work end having a casing attached thereto, wherein said casing is magnetic;

a plurality of limp tentacles wherein each of said tentacles has a working end and a proximal end;

said casing encloses said proximal ends of said tentacles.

4. The apparatus of claim three wherein said tentacles are rubber.

* * * * *